US007014506B2

(12) United States Patent
Ho et al.

(10) Patent No.: US 7,014,506 B2
(45) Date of Patent: Mar. 21, 2006

(54) BOARD MOUNTED MEMORY CARD CONNECTOR

(75) Inventors: Yi-Tse Ho, Tainan Hsien (TW); Katsutoshi Tojo, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/032,781

(22) Filed: Jan. 10, 2005

(65) Prior Publication Data

US 2005/0215084 A1 Sep. 29, 2005

(30) Foreign Application Priority Data

Jan. 9, 2004 (CN) ..... 2004101645 A

(51) Int. Cl.
*H01R 13/648* (2006.01)

(52) U.S. Cl. ..... 439/607; 439/541.5; 439/108; 439/573

(58) Field of Classification Search ..... 439/108, 439/97, 607, 541.5, 573
See application file for complete search history.

(56) References Cited

U.S. PATENT DOCUMENTS 5,470,259 A * 11/1995 Kaufman et al. ..... 439/607
5,795,190 A * 8/1998 Ono ..... 439/607
6,120,325 A * 9/2000 Abe ..... 439/607
6,354,876 B1 * 3/2002 Yu ..... 439/607
6,558,192 B1 * 5/2003 Kuo ..... 439/541.5
6,736,671 B1 * 5/2004 Lee ..... 439/541.5

* cited by examiner

*Primary Examiner*—Tho D. Ta
(74) *Attorney, Agent, or Firm*—Charles S. Cohen

(57) ABSTRACT

A memory card connector is provided for mounting on a printed circuit board which includes connecting terminals and at least one ground pad. The connector includes an insulative housing having a rear terminal-mounting section defining at least part of a receptacle for receiving a mating end of a memory card. The housing has a fixing base portion disposed over the ground pad on the printed circuit board when the connector is mounted thereon. A plurality of conductive terminals are mounted on the terminal-mounting section of the housing for electrical connection between the memory card and the connecting terminals on the printed circuit board. A grounding shield is mounted on the housing for shielding the conductive terminals. The shield includes a grounding portion disposed beneath the fixing base portion of the housing in engagement with the ground pad on the printed circuit board.

17 Claims, 5 Drawing Sheets

BOARD MOUNTED MEMORY CARD CONNECTOR

FIELD OF THE INVENTION

This invention generally relates to the art of electrical connectors and, particularly, to a memory card connector for mounting on a printed circuit board.

BACKGROUND OF THE INVENTION

Memory cards are known in the art and contain intelligence in the form of a memory circuit or other electronic program. Some form of card reader reads the information or memory stored on the card. Such cards are used in many applications in today's electronic society, including video cameras, digital still cameras, smart phones, PDA's, music players, ATMs, cable television decoders, toys, games, PC adapters, multi-media cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector often is mounted on a printed circuit board. The memory card, itself, writes or reads via the connector and can transmit between electrical appliances, such as a word processor, personal computer, personal data assistant or the like. With circuit board mounted connectors, the terminals of a connector include tail portions which are connected to appropriate circuit traces on the printed circuit board by various systems, such as surface mount technology where the tail portions are reflow soldered to the circuit traces. Through hole technology involves inserting the tail portions of the terminals into the holes in the printed circuit board for connection, as by soldering, to circuit traces on the board and/or in the holes.

Such memory card connectors, including those mounted on printed circuit boards, often include a grounding shield which substantially covers at least the contact areas of the terminals, while also effecting grounding of the connector. Mounting the shields often is difficult, particularly when the connector is mounted on a circuit board.

FIG. 1 shows a shielded, board mounted memory card connector, generally designated 12, according to the prior art. The connector includes a housing or body 14 which mounts a plurality of signal terminals 16 which have contact portions extending forwardly of the body. The terminals have tail portions which are connected, as by soldering, to appropriate circuit traces on a printed circuit board 18. One or more grounding shields 20 cover the terminals. The grounding shields have tail portions 20*a* which are connected, as by soldering, to appropriate ground traces on the circuit board either by surface mount technology or through hole technology. Problems occur with the ever-increasing miniaturization of such connectors as well as the ever-increasing density of the connector terminals. Short circuits can occur between adjacent tail portions of the terminals and/or the grounding shields, resulting in poor connections. Special tools are required to detach the connector from the board if short circuits or poor connections are found. This not only must be performed with very skillful techniques, but considerable time and material is wasted.

FIG. 2 shows a prior art system designed to avoid the problems described above in relation to the prior art connector of FIG. 1. Similar systems can be derived from U.S. Pat. No. 5,711,679 as well as Taiwan Patent Nos. 5216014 and 86206167. Other than the fact that the connector shown in FIG. 2 is a "dual port" connector involving a pair of stacked connectors, generally designated 12A, the connectors again are designed for mounting on a printed circuit board 18. In this prior art system, a pair of header connectors 22 are mounted on the circuit board. Each connector 12A includes a plurality of terminal pins 24 projecting rearwardly therefrom. Each connector includes a grounding shield 26 having tail portions 26*a* projecting rearwardly from the connectors generally parallel to terminal pins 24. In order to avoid the problems associated with the solder connections described above in relation to FIG. 1, the prior art system of FIG. 2 employs a pair of daughter printed circuit boards 28 to which terminal pins 24 and tail portions 26*a* of grounding shields 26 are terminated, as by soldering. The daughter boards are inserted into header connectors 22 mounted to the top of circuit board 18. Although the system of FIG. 2 eliminates some of the problems of the prior art of FIG. 1, since the terminals of header connectors 22 are soldered to circuit board 18, and terminal pins 24 and tail portions 26*a* are soldered to daughter boards 28, the number of soldering points is significantly increased. This increases the resistance of the connector, reducing the conductive efficiency thereof. The significantly increased number of solder points logically increases the chances of poor solder connections.

Another system of the prior art is shown in Taiwan Patent Application No. 87206371 and as depicted in FIG. 3 to eliminate the problems of the prior art shown in FIG. 1. Specifically, FIG. 3 shows that connector 12 includes a single grounding shield 20A which spans the entire length of the array of terminals 16. The shield has a pair of grounding feet 20*a* which are disposed outside the array of signal terminals. The grounding feet are soldered to grounding pads on circuit board 18 outside the terminals and, thereby, does not interfere with the solder connections of the terminals. Unfortunately, the relatively large, single grounding shield is fixed to the circuit board at only two locations and has a tendency to become broken-away from the board.

The present invention is directed to solving the myriad of problems described above in relation to the prior art systems shown in FIGS. 1–3 and described above.

SUMMARY OF THE INVENTION

An object, therefore, of the invention is to provide a new and improved memory card connector of the character described for mounting on a printed circuit board, the board including connecting terminals and at least one ground pad.

In the exemplary embodiment of the invention, the connector includes an insulative housing having a rear terminal-mounting section defining at least part of a receptacle for receiving a mating end of a memory card. The housing has a fixing base portion disposed over the ground pad on the printed circuit board when the connector is mounted thereon. A plurality of conductive terminals are mounted on the terminal-mounting section of the housing for electrical connection between the memory card and the connecting terminals on the printed circuit board. A grounding shield is mounted on the housing for shielding the conductive terminals. The shield includes a grounding portion disposed beneath the fixing base portion of the housing in engagement with the ground pad on the printed circuit board.

As disclosed herein, the printed circuit board includes a linear array of connecting terminals, with a pair of ground pads at opposite ends thereof. The connector housing includes a corresponding pair of the fixing base portions, and the grounding shield includes a corresponding pair of the grounding portions for disposition between the pair of fixing base portions and the ground pads.

According to an aspect of the invention, the printed circuit board includes a through hole extending though the ground pad for receiving a fastener. The fixing base portion of the housing includes a through hole for receiving the fastener. As disclosed herein, the fastener comprises an externally threaded bolt, and the housing includes a polygonal recess about the through hole in the fixing base portion for receiving an internally threaded cap for threadedly receiving the bolt.

Other features of the invention include complementary interengaging latch means between the grounding shield and the housing. The latch means are disposed between the fixing base portion of the housing and the grounding portion of the shield.

Another feature involves the connecting terminals on the printed circuit board being in a receptacle connector mounted on the board. A daughter circuit board is terminated to the conductive terminals of the connector and is insertable into the receptacle connector. The connector terminals include terminal pins inserted into holes in the daughter board. A pin alignment plate is provided with through holes for receiving the terminal pins and aligning the pins with the holes in the daughter board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
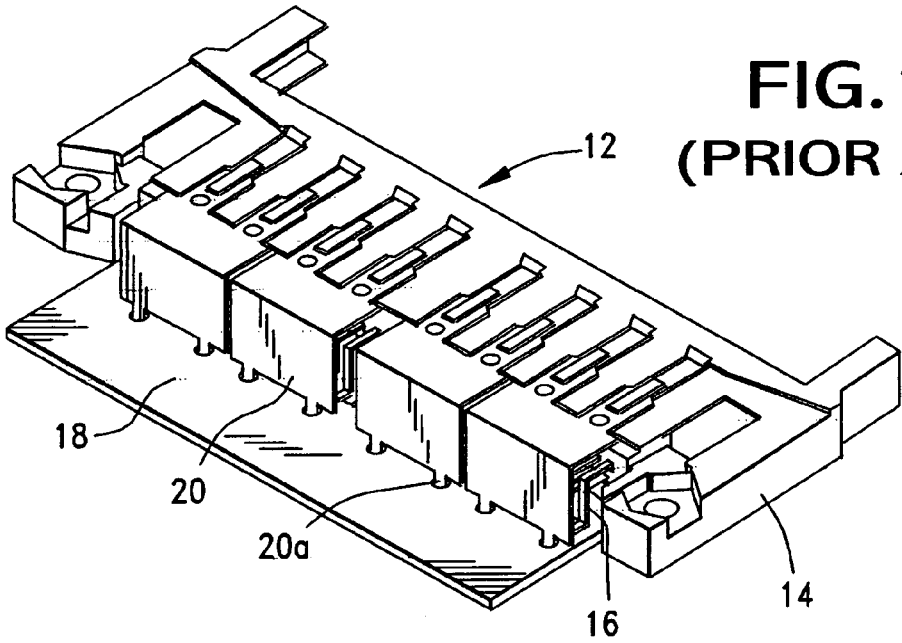
FIG. 1 (PRIOR ART)
FIGS. 1–3 are views of prior art memory card connectors as described in the Background, above.
Figure 2:
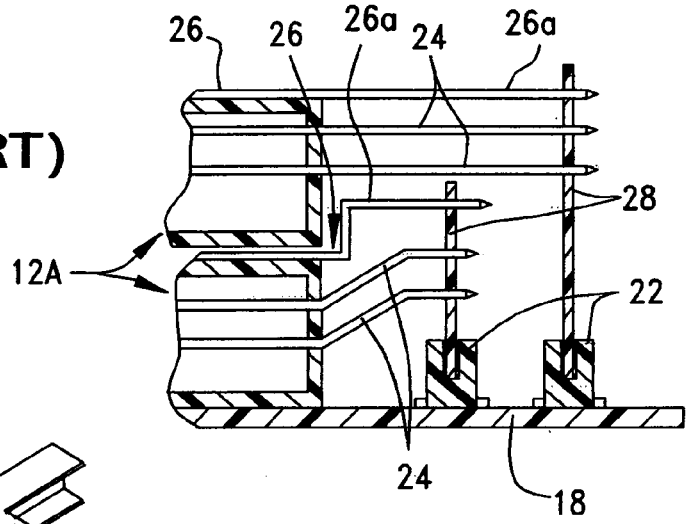
FIG. 2 (PRIOR ART)
Figure 3:
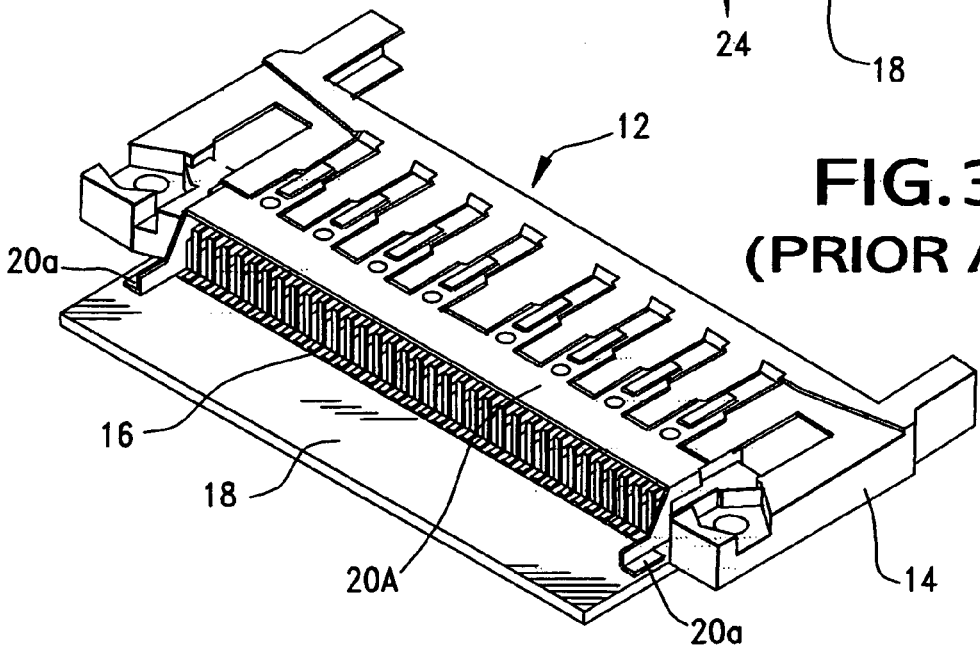
FIG. 3 (PRIOR ART)
Figure 4:
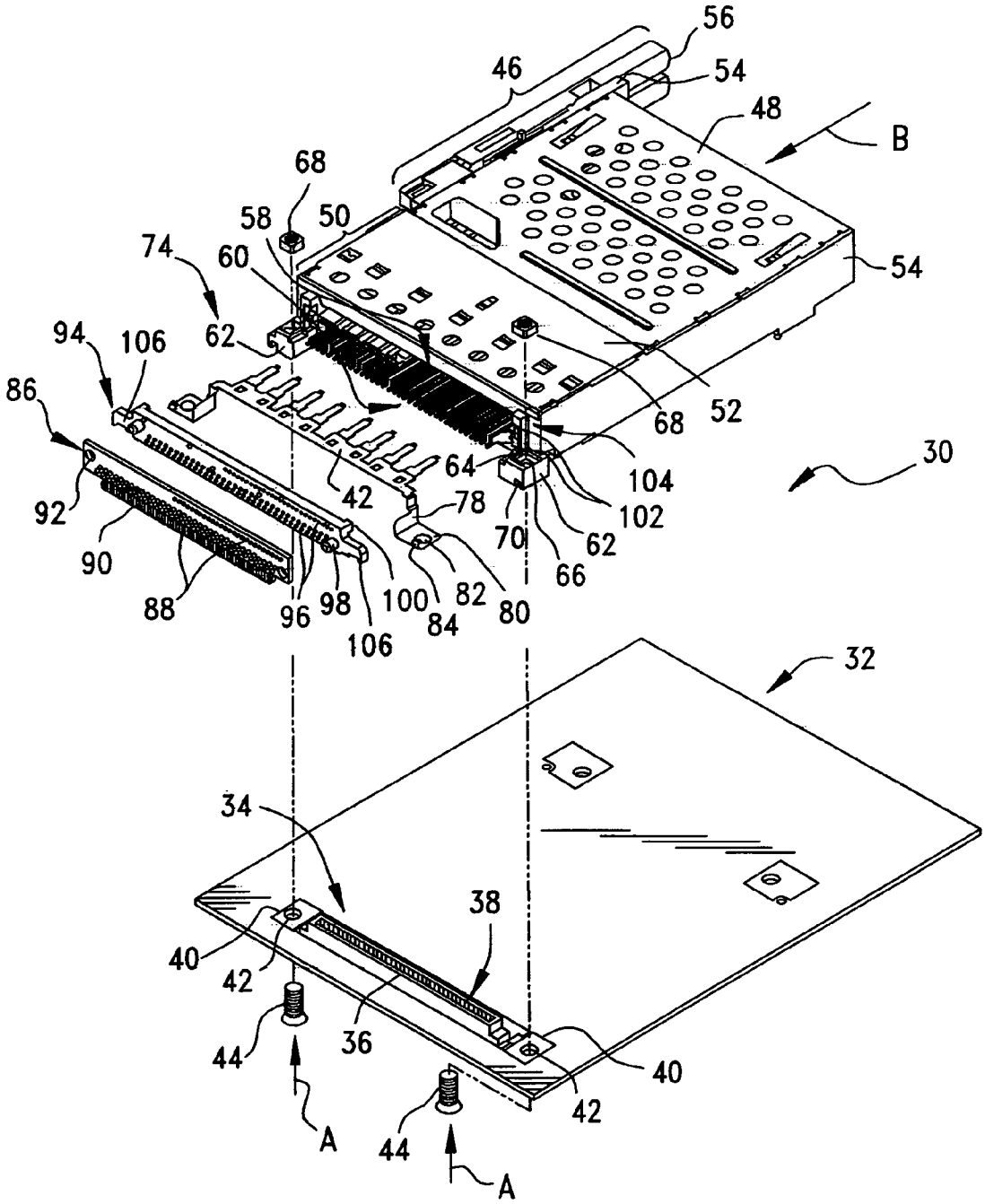
FIG. 4 is an exploded, top perspective view of a memory card connector according to the invention.
Figure 5:
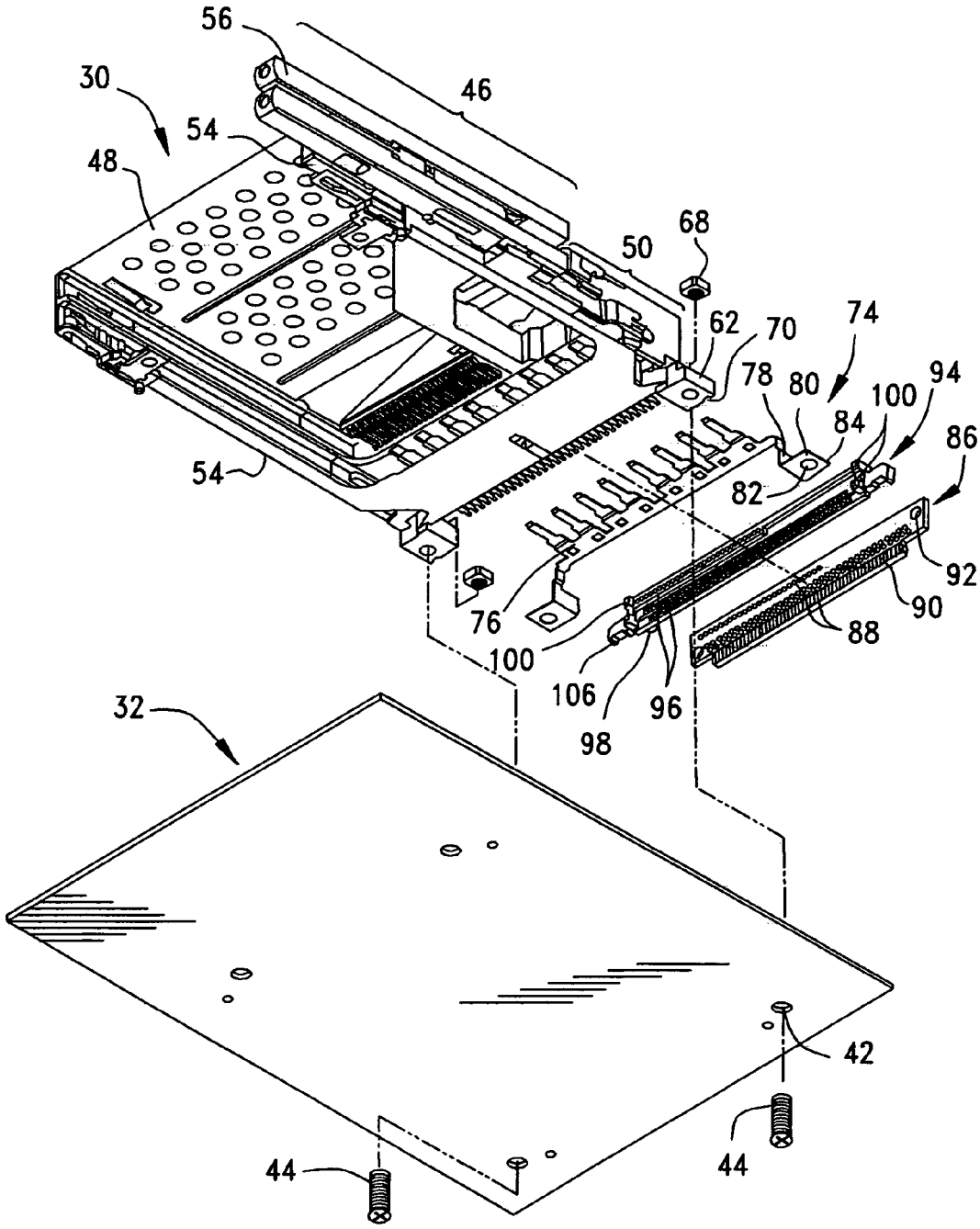
FIG. 5 is an exploded, bottom perspective view of the memory card connector of FIG. 4.

Referring to the drawings in greater detail, and first to FIGS. 4 and 5, the invention is embodied in a memory card connector, generally designated 30, for mounting onto a printed circuit board, generally designated 32. An elongated receptacle or header connector, generally designated 34, is mounted on circuit board 32. The header connector mounts a plurality of connecting terminals 36 and includes an insertion slot 38. A pair of ground pads 40 are disposed on the circuit board at opposite ends of header connector 34. A through hole 42 extends through each ground pad 40 and entirely through the circuit board. A pair of externally threaded fasteners 44 are inserted upwardly in the direction of arrows "A" (FIG. 4) through the circuit board, through holes 42 in ground pads 40 and into the connector for securing the connector to the circuit board as will be described in greater detail hereinafter.

Memory card connector 30 includes a mating body 46 having a shield 48 and a mating head 50 having a shield 52. A pair of side brackets 54 define an insertion slot therebetween for inserting a memory card into the connector in the direction of arrow "B" (FIG. 4). A card eject mechanism 56 is provided at one side of the connector. In the embodiment of FIGS. 4 and 5, the connector is a dual-port connector and includes two insertion slots for receiving two memory cards in upper and lower slots for stacking the two memory cards within the connector.

Mating head 50 comprises a terminal-mounting section at the rear of the connector and has a plurality of through grooves (not referenced) for receiving two sets of conductive signal terminals, generally designated 58 and 60, to be electrically connected to appropriate contacts on the two memory cards. The signal terminals extend inwardly into the receiving slots of mating body 46 and include pin portions which project rearwardly of the connector. The terminals extend in longitudinal arrays across the rear of the housing, and the housing has a pair of fixing base portions or blocks 62 outside opposite ends of the arrays of terminals. When the connector is mounted onto printed circuit board 32, fixing blocks 62 are disposed immediately above ground pads 40 on the circuit board. Each fixing block has a through hole 64 vertically therethrough, with a polygonal recess 66 in the top of the fixing block about the through hole. An internally threaded cap 68 has an external polygonal configuration and is positionable into each polygonal recess 66 for receiving one of the externally threaded bolts 44. Each fixing block 62 also has a latching hole 70 in a bottom rear face thereof.

A grounding shield, generally designated 74, is stamped and formed of conductive sheet metal material and includes a shielding portion 76 for shielding signal terminals 58 and 60. A pair of arms 78 project downwardly from opposite ends of shielding portion 62 and terminate in a pair of generally planar grounding portions 80 having through holes 82. A latch projection 84 projects upwardly from a rear edge of each grounding portion 80. When grounding shield 74 is assembled to the connector, there are eight shielding fingers which project forwardly from shielding portion 42 for shielding the signal terminals to avoid electromagnetic interference therewith. Shielding portion 76 is arranged between the two sets or groups of signal terminals 58 and 60. Grounding portions 70 are sandwiched between fixing blocks 62 of the housing and ground pads 40 on circuit board 32. When the connector is clamped to the circuit board, externally threaded bolts 44 and internally threaded caps 68 are effective to rigidly clamp the grounding portions 70 to the ground pads 40 on the circuit board, without any solder connections whatsoever.

There are various ways for electrically connecting signal terminals 58 and 60 to the connecting terminals on circuit board 32. In the illustrated embodiment, a daughter circuit board, generally designated 86, includes a plurality of through holes 88 for receiving the pin portions of signal terminals 58 and 60. The daughter board has a contact flange 90 with circuit traces thereon connectable to the terminal pins of signal terminals 58 and 60. Contact flange 90 of daughter board 86 is insertable into insertion slot 38 of header connector 34 on circuit board 32 to connect the signal terminals to connecting terminals 36 of the header connector. Daughter board 86 has a pair of positioning holes 92, for purposes described hereinafter. In essence, connecting terminals 36 of header connector 34 are connected to the pin portions of signal terminals 58 and 60 by circuitry on the daughter board between the contacts on flange 90 and circuitry within through holes 88 of the daughter board.

A terminal pin alignment plate, generally designated 94, includes a plurality of through holes 96 for receiving the terminal pins of signal terminals 58 and 60 and aligning the terminal pins with holes 88 in daughter circuit board 86.

Alignment means are providing between pin alignment plate 94 and daughter circuit board 86. Specifically, a pair of positioning posts or bosses 98 project rearwardly of pin alignment plate 94 for insertion into positioning holes 92 in the daughter circuit board. The pin alignment plate also is provided with positioning bosses 100 which protrude forwardly and are positionable into positioning slots 102 at the rear of the housing. Positional plates 104 at opposite sides of the housing engage the outsides of downwardly bent arms 78 of grounding shield 74.

Figure 6:
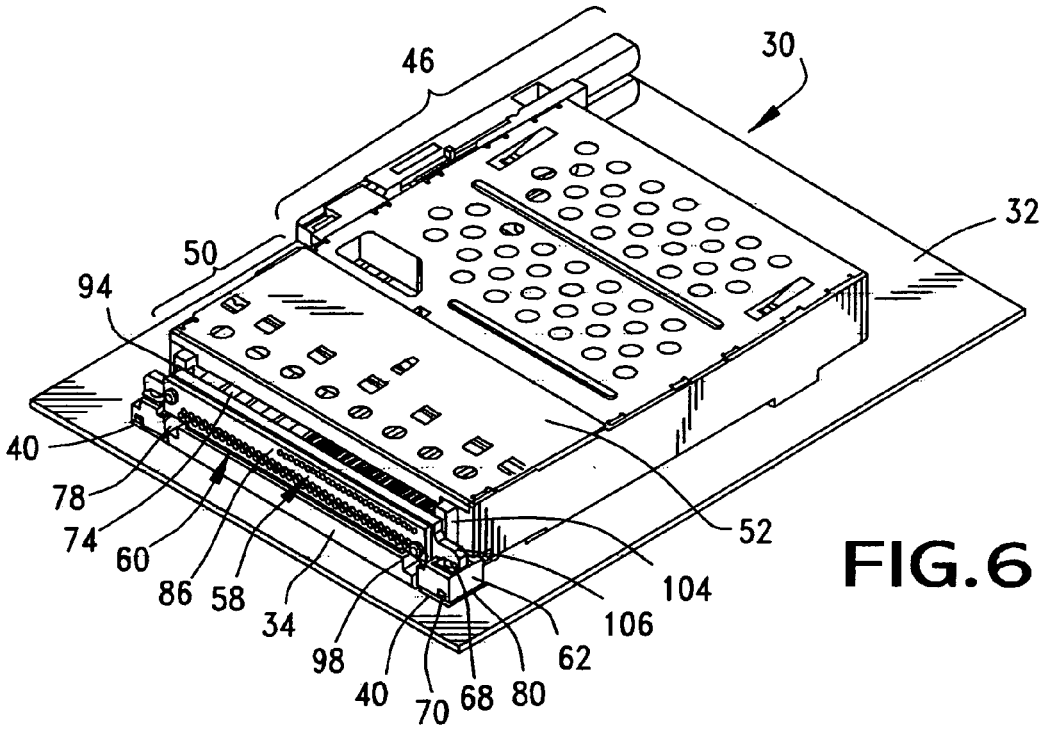
FIG. 6 is a perspective view of the connector in assembled condition and mounted onto a printed circuit board.
Figure 7:
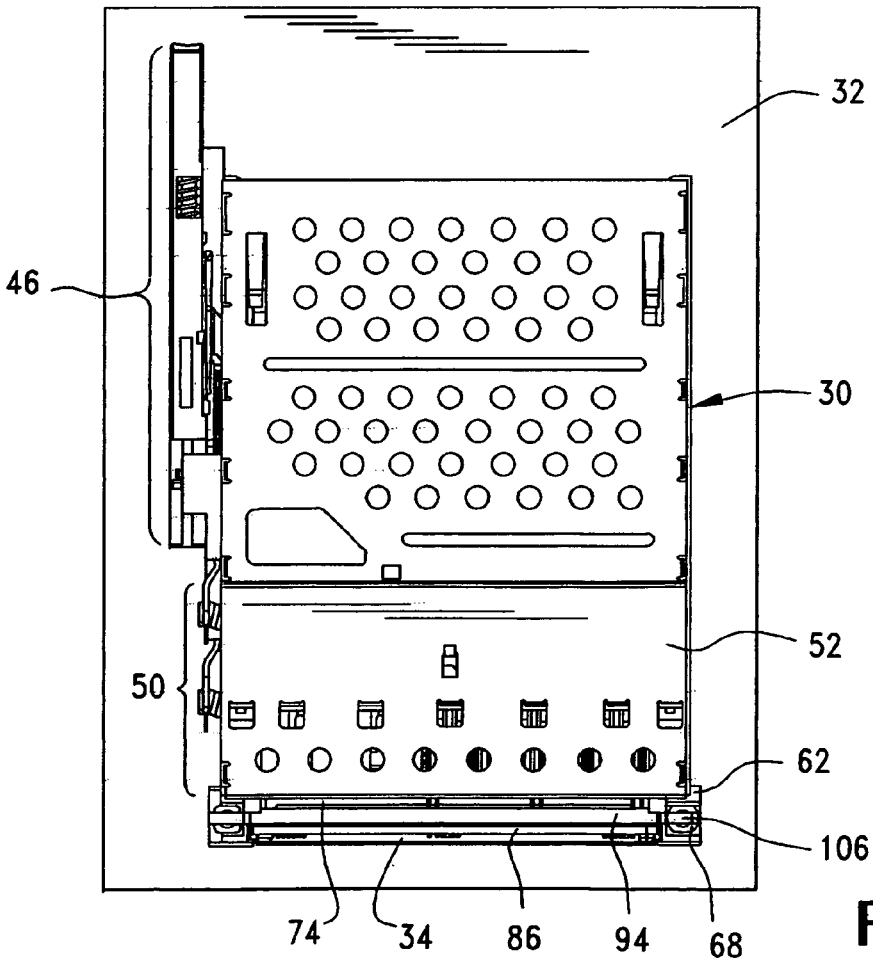
FIG. 7 is a top plan view of the connector.
Figure 8:
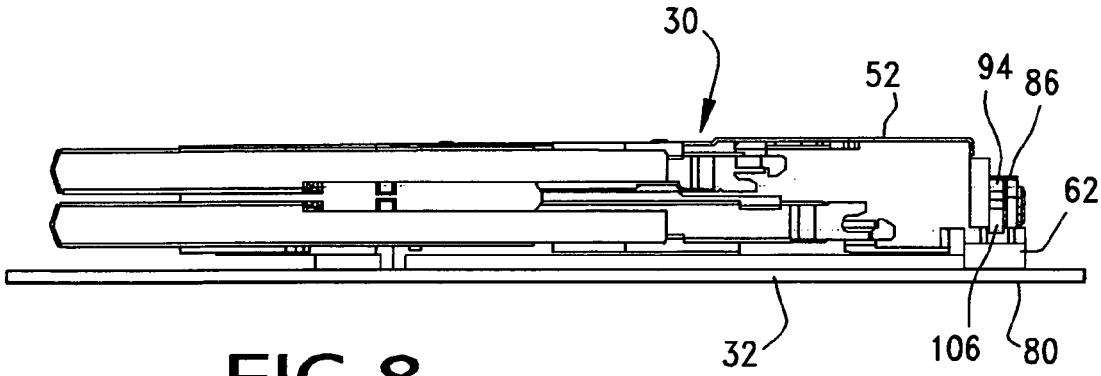
FIG. 8 is a side elevational view of the connector, looking toward the left-hand side in FIG. 7.
Figure 9:
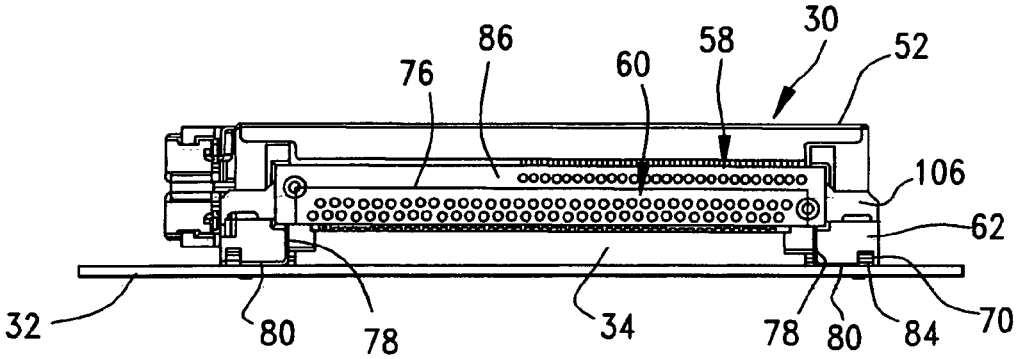
FIG. 9 is a front elevational view of the connector.

Finally, pin alignment plate 94 includes a pair of retaining arms 106 which project from opposite ends thereof and which seat onto the top of caps 68 as seen in FIG. 6.

The memory card connector 30 as described above in relation to FIGS. 4 and 5 is assembled as shown in FIGS. 6–9 by assembling grounding shield 74, pin alignment plate 94 and daughter circuit board 86 to the rear of the connector. This assembly then is positioned onto the top of printed circuit board 32, and contact flange 90 of the daughter board is inserted into insertion slot 38 of header connector 34 on the circuit board. Fasteners 44 then are inserted upwardly through the circuit board, through holes 42 in ground pads 40, through holes 82 in grounding shield 74, though holes 64 in fixing blocks 62 of the connector housing, and internally threaded into polygonal caps 68 in polygonal recesses 66 in the tops of the fixing blocks. Rotation of the bolts draws the entire assembly down onto the printed circuit board and rigidly clamps grounding portions 80 of grounding shield 74 between ground pads 40 on the circuit board and fixing blocks 62 of the connector housing. No solder connections are required between grounding shield 74 and any ground pads on the circuit board nor between daughter circuit board 86 and header connector 34.

Figure 10:
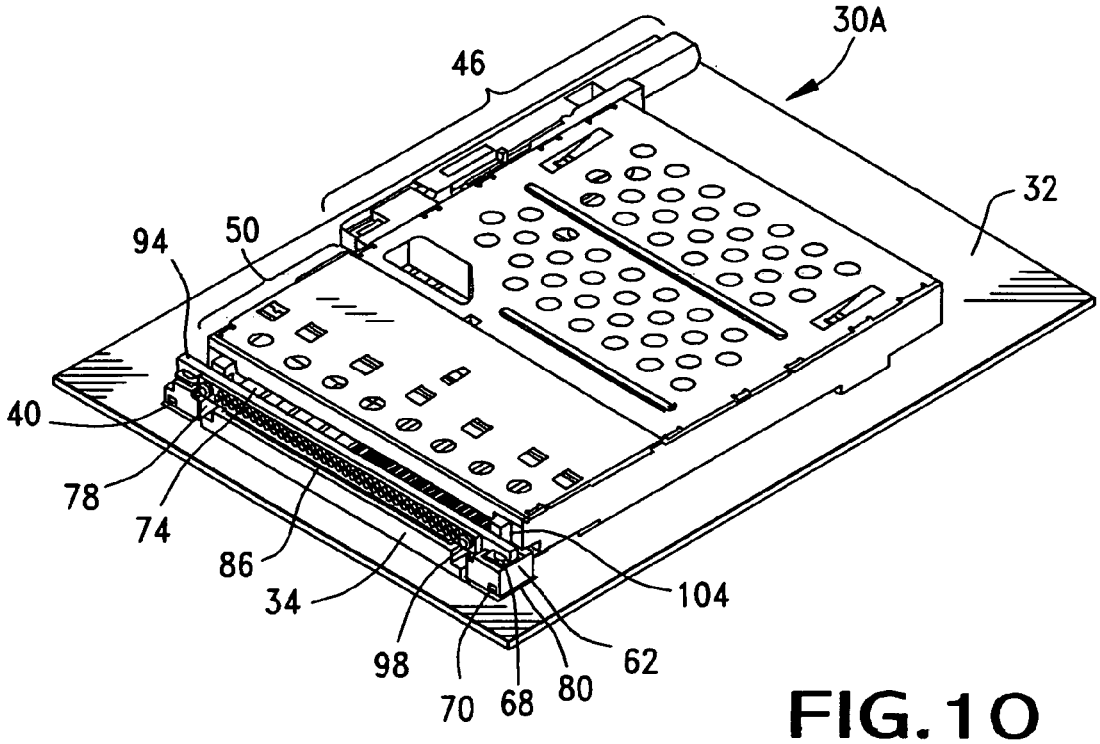
FIG. 10 is a view similar to that of FIG. 6, but of a single port connector.

FIG. 10 simply shows an embodiment of the invention in a memory card connector, generally designated 30A, which is a "single-port" connector for receiving a single memory card, versus the "dual-port" connector 30 which receives a pair of memory cards. Otherwise, the invention is incorporated similarly in connector 30A in FIG. 10, and like reference numerals have been applied in FIG. 10 corresponding to like components described above in relation to the first embodiment of FIGS. 4–9. Descriptions of those like components have not been repeated. Otherwise, the invention functions the same in both embodiments.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A memory card connector for mounting on a printed circuit board which includes connecting terminals and at least one ground pad, comprising:

an insulative housing having a rear terminal-mounting section defining at least part of a receptacle for receiving a mating end of a memory card, and a fixing base portion disposed over the ground pad on the printed circuit board when the connector is mounted thereon;

a plurality of conductive terminals mounted on the terminal-mounting section of the housing for electrical connection between the memory card and the connecting terminals in a receptacle connector on the printed circuit board;

a grounding shield mounted on the housing for shielding the conductive terminals and including a grounding portion disposed beneath the fixing base portion of the housing in engagement with the ground pad on the printed circuit board: and a daughter circuit board terminated to said conductive terminals and insertable into the receptacle connector, the conductive terminals including terminal pins inserted into holes in the daughter circuit board and including a pin alignment plate having through holes for receiving the terminal pins and aligning the pins with the holes in the daughter circuit board.

2. The memory card connector of claim 1 wherein said printed circuit board includes a linear array of connecting terminals with a pair of ground pads at opposite ends thereof, and said housing includes a corresponding pair of said fixing base portions, and the grounding shield includes a corresponding pair of said grounding portions for disposition between the pair of fixing base portions and the ground pads.

3. The memory card connector of claim 1, including complementary interengaging alignment means between the pin alignment plate and the daughter circuit board.

4. The memory card connector of claim 1, including complementary interengaging positioned means between the pin alignment plate and the housing.

5. The memory card connector of claim 1, including a fastening element on the fixing base portion of the housing for fastening engagement with a fastener from the printed circuit board, and the pin alignment plate includes a retaining portion for engaging the fastening element.

6. The memory card connector of claim 1 wherein said printed circuit board includes a through hole extending though said ground pad for receiving a fastener, and said fixing base portion of the housing includes a through hole for receiving the fastener.

7. The memory card connector of claim 6 wherein said fastener comprises an externally threaded bolt, and the housing includes a polygonal recess about the through hole in the fixing base portion for receiving an internally threaded cap for threadedly receiving the bolt.

8. The memory card connector of claim 1, including complementary interengaging latch means between the grounding shield and the housing.

9. The memory card connector of claim 8 wherein said latch means is disposed between the fixing base portion of the housing and the grounding portion of the grounding shield.

10. A memory card connector for mounting on a printed circuit board which includes a linear array of connecting terminals and a pair of ground pads at opposite ends thereof with through holes in the circuit board extending through the ground pads, comprising:

an insulative housing having a rear terminal-mounting section defining at least part of a receptacle for receiving a mating end of a memory card, and a pair of fixing base portions disposed at opposite sides of the housing over the ground pads on the printed circuit board when the connector is mounted thereon, the fixing base portions having through holes in alignment with the holes in the circuit board and ground pads;

a plurality of conductive terminals mounted on the terminal-mounting section of the housing for electrical connection between the memory card and the connecting terminals on in a receptacle connector the printed circuit board;

a grounding shield mounted on the housing for shielding the conductive terminals and including a pair of grounding portions disposed beneath the fixing base portions of the housing in engagement with the ground pads on the circuit board, the grounding portions having through holes in alignment with the through holes in the fixing base portions and the through holes in the circuit board and ground pads;

a daughter circuit board terminated to said conductive terminals and insertable into the receptacle connector, said conductive terminals include terminal pins inserted into holes in the daughter circuit board, and including a pin alignment plate having through holes for receiving the terminal pins and aligning the pins with the holes in the daughter circuit board; and a pair of fasteners insertable through the holes in the printed circuit board and ground pads on the circuit board, the holes in the grounding portions of the grounding shield and the holes in the fixing base portions of the housing to clamp the grounding portions of the grounding shield between the fixing base portions and the ground pads on the circuit board.

11. The memory card connector of claim 10, including complementary interengaging alignment means between the pin alignment plate and the daughter circuit board.

12. The memory card connector of claim 10, including complementary interengaging positioned means between the pin alignment plate and the housing.

13. The memory card connector of claim 10, including a pair of fastening elements on the fixing base portions of the housing for fastening engagement with said fasteners, and the pin alignment plate includes retaining portions for engaging the fastening elements.

14. The memory card connector of claim 10 wherein said fasteners comprise externally threaded bolts, and the housing includes a polygonal recesses about the through holes in the fixing base portions for receiving internally threaded caps for threadedly receiving the bolts.

15. The memory card connector of claim 10, including complementary interengaging latch means between the grounding shield and the housing.

16. The memory card connector of claim 15 wherein said latch means is disposed between the fixing base portion of the housing and the grounding portion of the grounding shield.

17. A memory card connector for mounting on a printed circuit board which includes connecting terminals and at least one ground pad, comprising:

an insulative housing having a rear terminal-mounting section defining at least part of a receptacle for receiving a mating end of a memory card, and a fixing base portion disposed over the ground pad on the printed circuit board when the connector is mounted thereon;

a plurality of conductive terminals mounted on the terminal-mounting section of the housing for electrical connection between the memory card and the connecting terminals in on the printed circuit board;

a grounding shield mounted on the housing for shielding the conductive terminals and including a grounding portion disposed beneath the fixing base portion of the housing in engagement with the ground pad on the printed circuit board; and said conductive terminals include terminal pins inserted into holes in a daughter circuit board, and including a pin alignment plate having through holes for receiving the terminal pins and aligning the pins with the holes in the daughter circuit board.

* * * * *